US008391746B2

(12) United States Patent
Nishida et al.

(10) Patent No.: US 8,391,746 B2
(45) Date of Patent: Mar. 5, 2013

(54) APPARATUS HOUSING AND IMAGE FORMING APPARATUS USING THE SAME

(75) Inventors: Masayoshi Nishida, Kanagawa (JP); Susumu Yamashina, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 282 days.

(21) Appl. No.: 12/827,483

(22) Filed: Jun. 30, 2010

(65) Prior Publication Data

US 2011/0013930 A1 Jan. 20, 2011

(30) Foreign Application Priority Data

Jul. 20, 2009 (JP) ..... 2009-169629

(51) Int. Cl.
*G03G 15/00* (2006.01)

(52) U.S. Cl. ..... 399/107; 399/110; D18/36; D18/37; D18/50; 361/679.01; 312/223.2

(58) Field of Classification Search ..... 399/107, 399/363; 361/679.01; D18/36, 37, 50; 312/223.2
See application file for complete search history.

(56) References Cited

U.S. PATENT DOCUMENTS

2005/0019058 A1* 1/2005 Hirose et al. ..... 399/110
2008/0003015 A1* 1/2008 Tomatsu ..... 399/110
2009/0169242 A1* 7/2009 Akiyama ..... 399/107
2009/0174297 A1* 7/2009 Yano et al. ..... 312/223.2

FOREIGN PATENT DOCUMENTS

| | | |
|---|---|---|
| JP | A-2000-71558 | 3/2000 |
| JP | A-2000-174451 | 6/2000 |
| JP | A-2002-287450 | 10/2002 |
| JP | B2-3677216 | 7/2005 |

* cited by examiner

*Primary Examiner* — David Gray
*Assistant Examiner* — Francis Gray
(74) *Attorney, Agent, or Firm* — Oliff & Berridge, PLC

(57) ABSTRACT

An apparatus housing includes: a housing frame that contains an image forming element therein; and an exterior cover fixed to an exterior of the housing frame, wherein the exterior cover has a specified-color exterior cover different in lightness from the housing frame, the specified-color exterior cover has a plurality of cover members that are adjacent to each other and disposed on at least one surface of the housing frame, and a blind portion for blinding the surface of the housing frame with a color whose lightness is more similar to that of the specified-color exterior cover than the housing frame is provided at an adjacent area between the plurality of cover members so that the surface of the housing frame is not exposed through a gap between the plurality of cover members, and wherein the blind portion is provided to at least one of the plurality of cover members, and the blind portion extends to cover the entire adjacent area of the other cover members.

20 Claims, 9 Drawing Sheets

APPARATUS HOUSING AND IMAGE FORMING APPARATUS USING THE SAME

CROSS-REFERENCE TO RELATED APPLICATION

This application is based on and claims priority under 35 USC 119 from Japanese Patent Application No. 2009-169629 filed Jul. 20, 2009.

BACKGROUND

Technical Field

The present invention relates to an apparatus housing and an image forming apparatus using the apparatus housing.

SUMMARY

According to an aspect of the present invention, there is provided an apparatus housing including: a housing frame that contains an image forming element therein; and an exterior cover fixed to an exterior of the housing frame, wherein the exterior cover has a specified-color exterior cover different in lightness from the housing frame, the specified-color exterior cover has a plurality of cover members that are adjacent to each other and disposed on at least one surface of the housing frame, and a blind portion for blinding the surface of the housing frame with a color whose lightness is more similar to that of the specified-color exterior cover than the housing frame is provided at an adjacent area between the plurality of cover members so that the surface of the housing frame is not exposed through a gap between the plurality of cover members, and wherein the blind portion is provided to at least one of the plurality of cover members, and the blind portion extends to cover the entire adjacent area of the other cover members.

BRIEF DESCRIPTION OF THE DRAWINGS

An exemplary embodiment of the present invention will be described in detail based on the following figures, wherein.

DETAILED DESCRIPTION

First, an exemplary embodiment of an image forming apparatus to which the present invention is applied will be briefly described with reference to FIG. 1A.

Figure 1C:
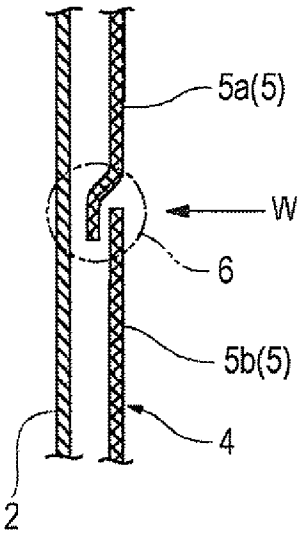
FIG. 1C is a cross-sectional view taken along C-C line of FIG. 1B.
Figure 1B:
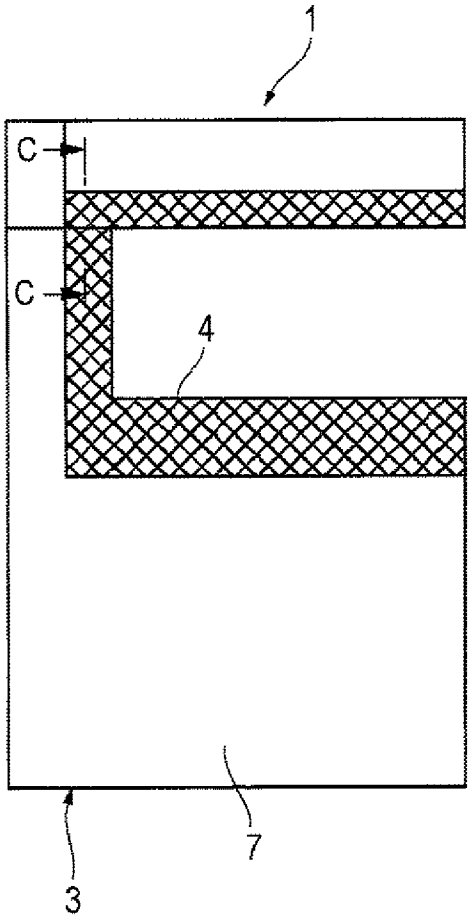
FIG. 1B is a diagram showing an apparatus housing of the image forming apparatus of FIG. 1A.
Figure 1A:
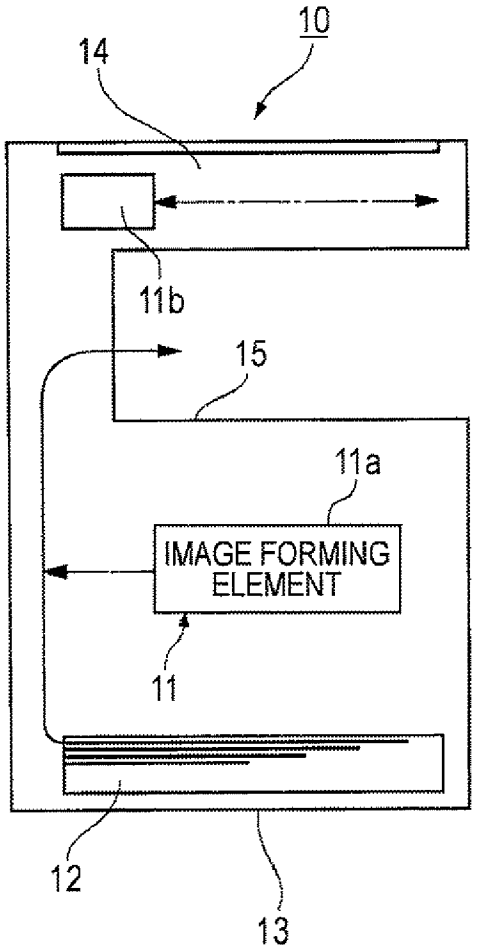
FIG. 1A is a diagram showing an exemplary embodiment of an image forming apparatus to which the present invention is applied.

In FIG. 1A, an image forming apparatus 10 has an apparatus housing 1 and image forming element 11 contained in the apparatus housing 1.

Here, as shown in FIGS. 1A to 1C, the apparatus housing 1 has a lower apparatus housing 13 containing an image forming element 11*a* for forming an image on a recording medium 12, an upper apparatus housing 14 containing an image reading element lib for reading a document image to be formed on the recording medium 12, and a recording medium stock unit 15 provided between the lower apparatus housing 13 and the upper apparatus housing 14 for stocking the recording medium 12 having an image formed thereon by the image forming element 11*a* in the lower apparatus housing 13. An exterior cover 4 of a specified-color is provided on the recording medium stock unit 15 and at least a part of the neighboring site to the recording medium stock unit 15 in the apparatus housing 1, and an exterior cover 7 of an unspecified-color is provided at the outside of the specified-color exterior cover 4. The specified-color exterior cover 4 will be described in detail later.

This exemplary embodiment relates to a so-called in-body discharge type image forming apparatus, and the recording medium stock unit 15 and the peripheral portion thereof in the apparatus housing 1 are provided with the exterior cover 4 of a specified-color, thereby providing an image forming apparatus which is designed so that the periphery of the recording medium stock unit 15 is emphasized.

Furthermore, describing the features of this exemplary embodiment, as shown in FIGS. 1B and 1C, the apparatus housing 1 has a housing frame 2 which is designed to contain the image forming element 11, and an exterior cover 3 fixed to the exterior of the housing frame 2. The exterior cover 3 has an exterior cover 4 of a specified-color which is different in hue from the housing frame 2, and the specified-color exterior cover 4 contains plural cover members 5 (for example, 5*a*, 5*b*) which are adjacently disposed on at least one surface of the housing frame 3, and the adjacent site of the plural cover members 5 (5*a*, 5*b*) is provided with a blind portion 6 for blinding the adjacent site with a color which is nearer in hue to the specified-color exterior cover 4 than the housing frame 2 so that the surface of the housing frame 2 is not exposed from the gap between the plural cover members 5 (5*a*, 5*b*).

In this technical construction, the housing frame 2 is defined as a member constituting a framework of the apparatus housing 1 by using metal or the like. The exterior cover 3 is defined as a cover mounted on the exterior of the housing frame 2.

Furthermore, the specified-color exterior cover 4 represents an exterior cover having a specified-color different in hue from the housing frame 2. Here, "difference in hue" is properly determined on the basis of whether a person who looks at the housing frame 2 through a gap of the exterior cover 3 feels odd about the difference in hue between the exterior cover 3 and the housing frame 2. For example, in a case where each of the exterior cover 3 and the housing frame 2 is expressed by three attributes of color (hue, value, chroma) of the Munsell color system, it may be considered that the exterior cover is regarded as the exterior cover 4 of the specified-color when the difference in each of hue, lightness and color saturation between the exterior cover 3 and the housing frame 2 is equal to three or more, and also regarded as an exterior cover 7 of an unspecified-color when the difference is equal to 2 or less. Furthermore, in a case where the distance on the space of a uniform color space is expressed by using the L*a*b color system, the exterior cover is regarded as the exterior cover 4 of the specified-color when the value of $\Delta E=[(\Delta L)*2+(\Delta*a)*2+(\Delta*a)2]^{1/2}$ is equal to about 10 or more.

Furthermore, the plural cover members 5 (for example, 5*a*, 5*b*) which are adjacently disposed on at least one surface are targeted as the specified-color exterior cover 4.

The blind portion 6 is required to have both of a function of preventing exposure of the surface of the housing frame 2 from the gaps between the plural cover members 5 and a function of blinding the surface of the housing frame 2 with a color which is nearer in hue to that of the exterior cover 4 of the specified-color than the housing frame 2.

An exterior cover having a hue which is different from that of the housing frame 2 by three or more in Munsell value is used as a representative example of the specified-color exterior cover 4. In a case where the exterior cover has a hue which is different by three or more in Munsell value as described above, when a gap is formed at the adjacent site between the plural cover members 5 (for example, 5*a*, 5*b*) constituting the specified-color exterior cover 4 and the surface of the housing frame 2 is exposed through the gap, it is apparently remarkable. Therefore, by blinding the surface of the housing frame 2 with the blind portion 6 of this exemplary embodiment, the reduction in appearance quality can be effectively suppressed even when the adjacent site of the cover members 5 (5*a*, 5*b*) of the specified-color exterior cover 4 is blinded.

Furthermore, as a representative example of the blind portion 6, there may be used an overhead flange which is provided to one or both of the plural cover members 5 (5*a*, 5*b*) so as to extend from the adjacent site end of one of the cover members 5*a* and 5*b* over the adjacent site end of the other cover member 5*b* or 5*a* as shown in FIG. 1C.

As another representative example of the blind portion 6, the surface of the housing frame is colored with a color whose hue is not different from that of the specified-color cover member in the adjacent site of the cover members 5 (5*a*, 5*b*).

Furthermore, as a representative example of the exterior cover 3, an unspecified-color exterior cover 7 which is not different in hue from the housing frame 2 is provided separately from the specified-color exterior cover 4, and the plural adjacently-disposed cover members 5 (5*a*, 5*b*) out of the specified-color exterior cover 4 have an adjacent site along an adjacent site of plural cover members constituting the unspecified-color cover member 7.

In this exemplary embodiment, the unspecified-color exterior cover 7 is provided in addition to the specified-color exterior cover 4, and an exterior design such as alignment of a line track along the adjacent site of the plural cover members 5 (5*a*, 5*b*) or the like can be performed in addition to the difference in hue between the unspecified-color exterior cover 7 and the specified-color exterior cover 4.

Furthermore, as a fixing structure based on a check for the specified-color exterior cover 4 may be used a structure that the specified-color exterior cover 4 is fixed to the housing frame 2 through a check and the head portion of the check is colored with a hue which is not different from that of the specified-color exterior cover 4, or a structure that the specified-color exterior cover 4 has a fixing recess portion in which a check is mounted so that the head portion thereof is not exposed from the surface of the fixing recess portion, and the fixing recess portion is fixed to the housing frame 2 through the check.

Next, the present invention will be described in more detail on the basis of exemplary embodiments shown in the figures.

[First Exemplary Embodiment]

Figure 2:
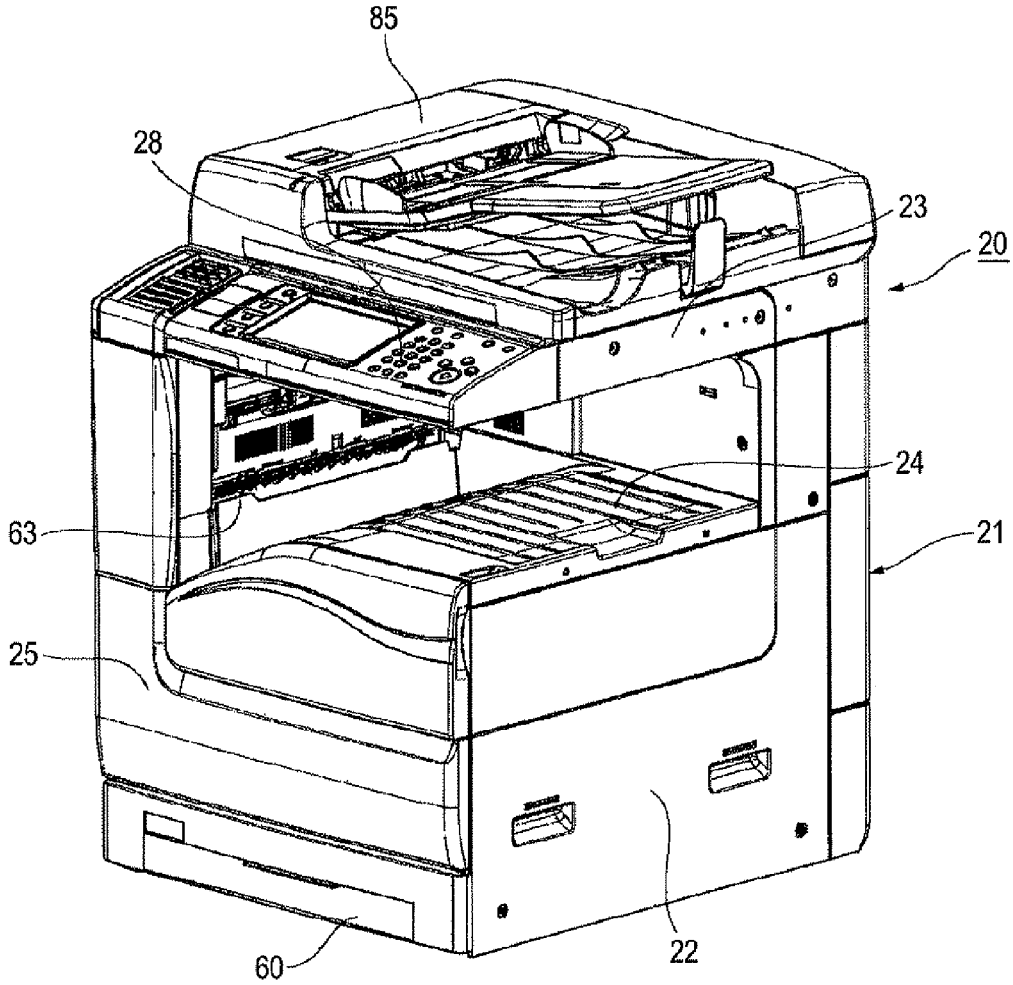
FIG. 2 is a perspective view showing the overall construction of the image forming apparatus according to a first exemplary embodiment.

FIG. 2 is a perspective view showing the overall construction of an image forming apparatus according to a first exemplary embodiment.

In FIG. 2, an image forming apparatus 20 has an apparatus housing 21 containing an image forming element, and the image forming element contains an image formation element for forming an image on a recording medium, and an image reading element for reading a document image to be formed on the recording medium.

Figure 4:
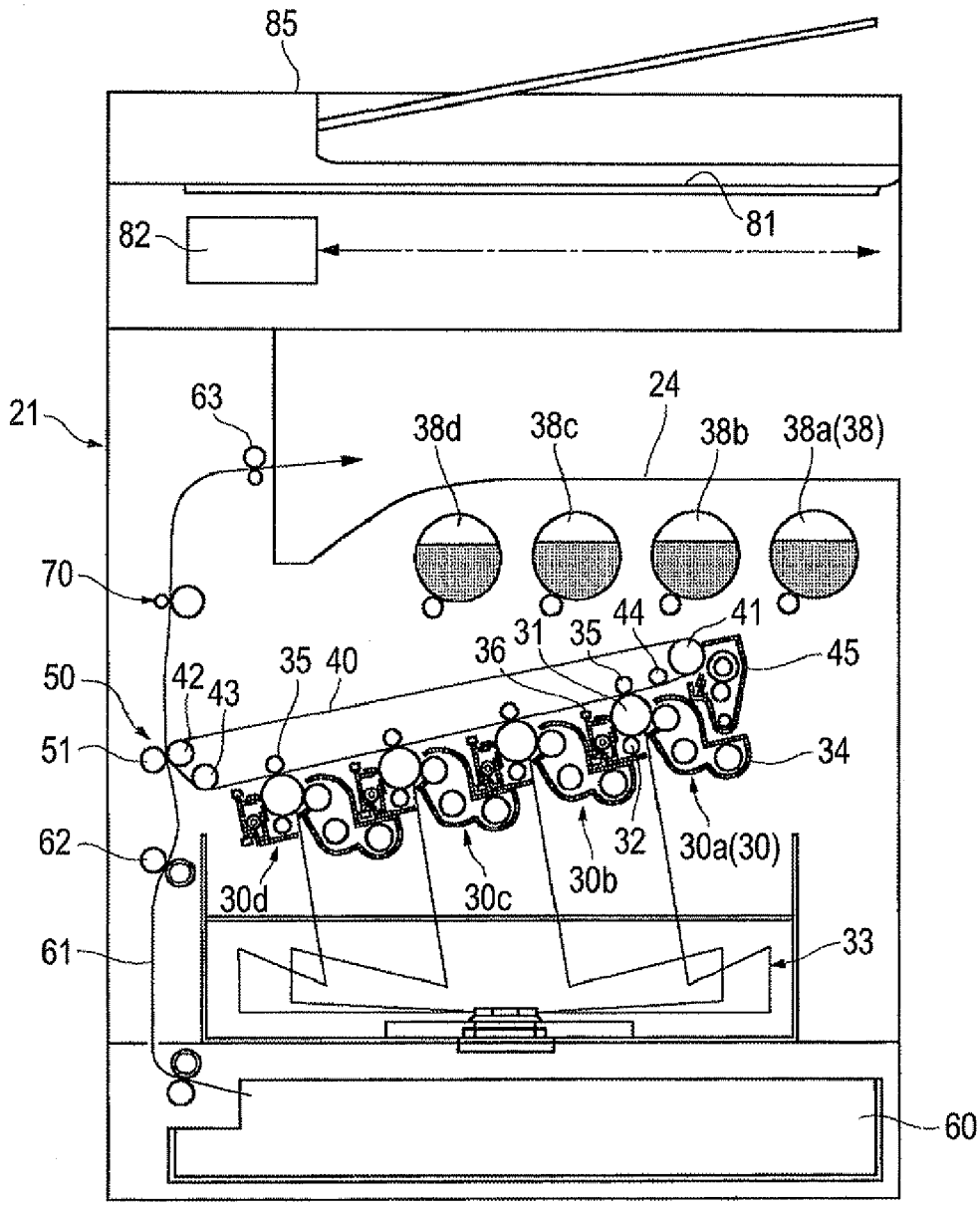
FIG. 4 is a diagram showing an image forming element of the image forming apparatus according to the first exemplary embodiment.

In this exemplary embodiment, as shown in FIG. 4, the imaging element has image forming units 30 (specifically, 30*a* to 30*d*) for forming plural color component images electrophotographically, an intermediate transfer medium 40 which is designed like a belt, for example and onto which images formed by the image forming units 30 are temporarily transferred before the images concerned are transferred onto a recording medium, and a batch transfer device 50 for transferring onto a recording medium the respective color component images which have been transferred on the intermediate transfer medium 40. A recording medium supplied from a recording medium supply device 60 disposed below the image forming units 30 is transported by a transporting roll 62 in a transporting path 61 extending substantially vertically, and images on the intermediate transfer medium 40 are collectively transferred onto the recording medium at a transfer site of the batch transfer device 50. Furthermore, the images on the recording medium are fixed by a fixing device 70 provided at the downstream side of the transporting path 61, and then the recording medium concerned is discharged into a recording medium stock unit 24 described later by a discharge roll 63 disposed just before the recording medium stock unit 24.

Here, each image forming unit 30 (30*a* to 30*d*) has, for example, a drum-shaped photoconductor 31, a charger 32 for charging the photoconductor 31, an exposure unit 33 such as a laser scanning device or the like for writing an electrostatic latent image on the charged photoconductor 31 with light, a developing unit 34 for developing the electrostatic latent image formed on the photoconductor 31 with a predetermined color component toner, a transfer unit 35 for transferring the developed image on the photoconductor 31 onto the intermediate transfer medium 40, and a cleaner 36 for cleaning residual toner on the photoconductor 31.

Reference numeral 38 (38*a* to 38*d*) represents a toner replenishing unit for replenishing each color component toner to the developing unit 34 of each image forming unit 30. In this exemplary embodiment, the exposure unit 33 may be provided every image forming unit 30 (30*a* to 30*d*), however, it may be commonly used by all the image forming units 30.

Furthermore, in this exemplary embodiment, the intermediate transfer medium 40 is laid over plural tension rolls 41 to 44, and circulatively rotated with the tension roll 41 as a driving roll. Reference numeral 45 represents an intermediate cleaner which is provided at the downstream side of the batch transfer device 50 in the transporting direction of the intermediate transfer medium 40 and cleans residual toner on the intermediate transfer medium 40.

Furthermore, the batch transfer device 50 has a batch transfer roll 51, and the batch transfer roll 51 pinches the intermediate transfer medium 40 in cooperation with the tension roll 42 of the intermediate transfer medium 40 which serves as a counter roll. Transfer electric field is formed between the batch transfer roll 51 and the tension roll 42 serving as the counter roll due to application of a transfer voltage therebetween.

The image reading element has a document table 81 on which a document to be read is placed. The document on the document table 81 is read by an image reading unit (scanner) 82, and an image signal of each color component is supplied to the exposure unit 33 through an image processor (not shown). Reference numeral 85 represents an automatic document feeder for automatically feeding a document onto the document table 81.

Figure 3:
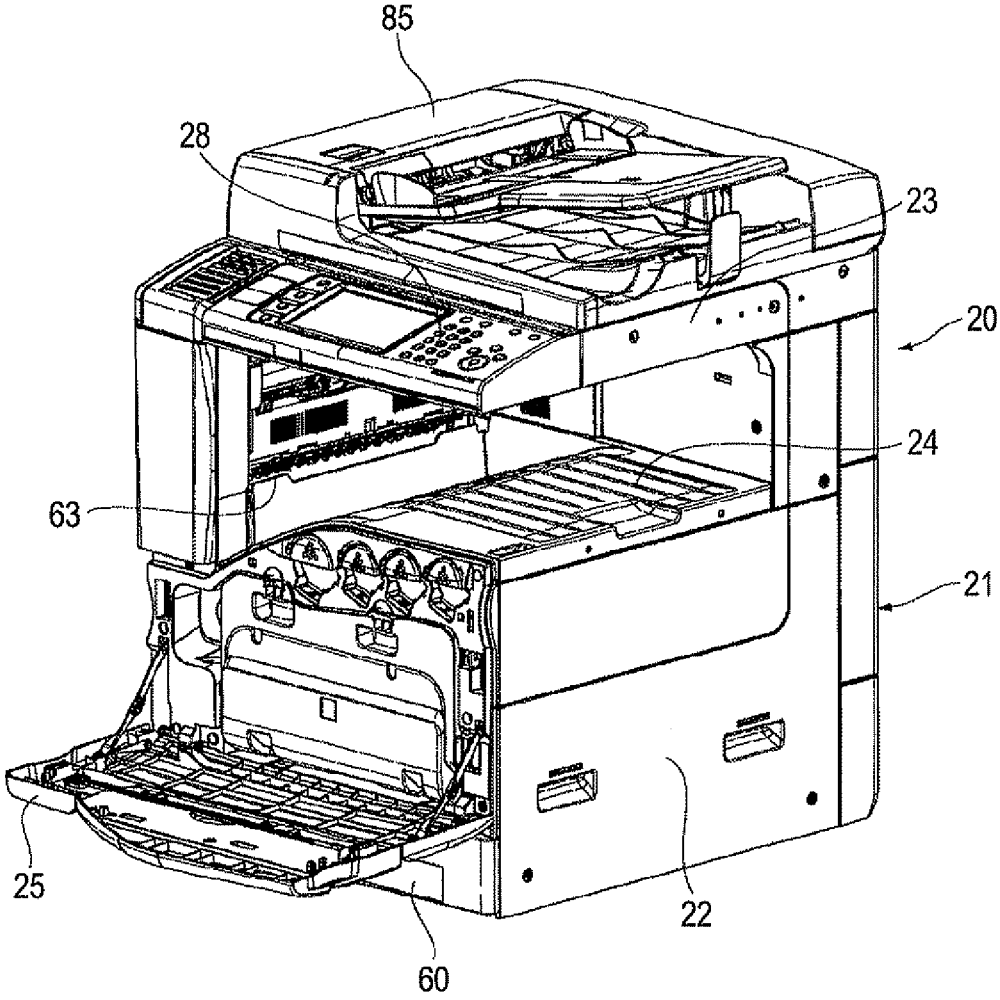
FIG. 3 is a diagram showing a state that an opening/closing door at the front side of the first exemplary embodiment is opened.

In this exemplary embodiment, as shown in FIGS. 2 and 3, the apparatus housing 21 has a lower apparatus housing 22 containing the imaging element for forming an image on a recording medium (not shown), an upper apparatus housing 23 containing the image reading element for reading a document image to be formed on a recording medium (not shown), and the recording medium stock unit 24 which is provided between the lower apparatus housing 22 and the upper apparatus housing 23 and stocks a recording medium on which an image is formed by the imaging element in the lower apparatus housing 22. An opening/closing door 25 is provided at the front side of the lower apparatus housing 22. An operating unit 28 for various operations to form an image is provided at the front side of the upper apparatus housing 23.

Furthermore, the apparatus housing 21 has a housing frame 100 (see FIG. 7) formed of a metal raw material such as SUS, aluminum or the like which serves as a framework of the apparatus housing 21, and an exterior cover 110 fixed to the exterior of the housing frame 100.

Figure 5:
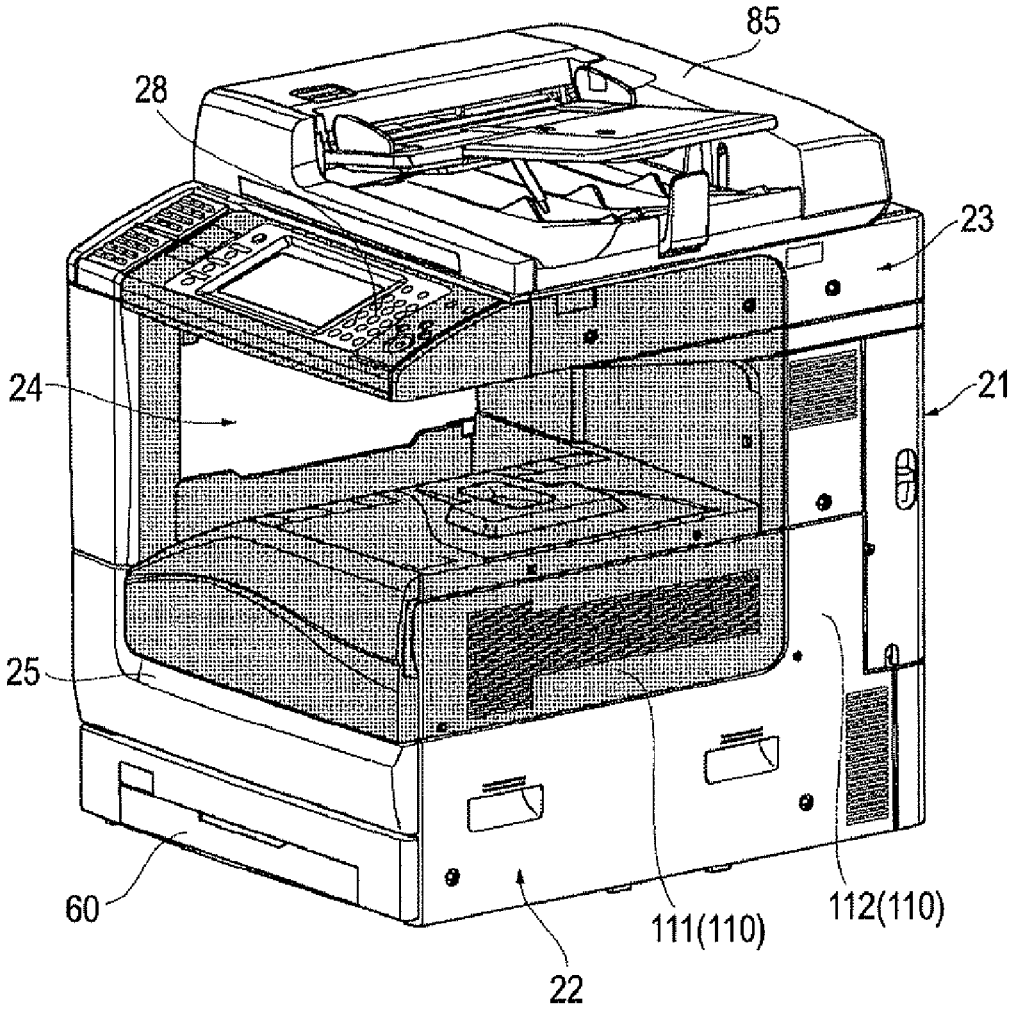
FIG. 5 is a diagram showing a main part of the apparatus housing used in the first exemplary embodiment.

In this exemplary embodiment, as shown in FIGS. 2, 3 and 5, the exterior cover 110 has a specified-color exterior cover 111 having a specified-color (for example, blue) which is different in hue from the housing frame 100, and an unspecified-color exterior cover 112 which is provided separately from the specified-color exterior cover 111 and colored with a hue which is not different from the housing frame 100.

In this exemplary embodiment, particularly, the density of the specified-color of the specified-color exterior cover 111 is different from the density of the housing frame 100 by three or more in the Munsell density, and the specified-color exterior cover 111 is more conspicuous in color as compared with the unspecified-color exterior cover 112.

In this exemplary embodiment, the opening/closing door 25 is configured to straddle the specified-color exterior cover 111 and the unspecified-color exterior cover 112.

According to this exemplary embodiment, the specified-color exterior cover 111 is disposed so as to surround the recording medium stock unit 24 and the peripheral site thereof, the unspecified-color exterior cover 112 is disposed around the specified-color exterior cover 111, and these exterior covers (the specified-color exterior cover 111 and the unspecified-color exterior cover 112) are fixed to the housing frame 100 by using checks. However, the fixing structure of the specified-color exterior cover 111 is slightly different from the fixing structure of the unspecified-color exterior cover 112.

The fixing structures of the specified-color exterior cover 111 and the unspecified-color exterior cover 112 will be described hereunder.

(1) Gap Treatment 1

Figure 6:
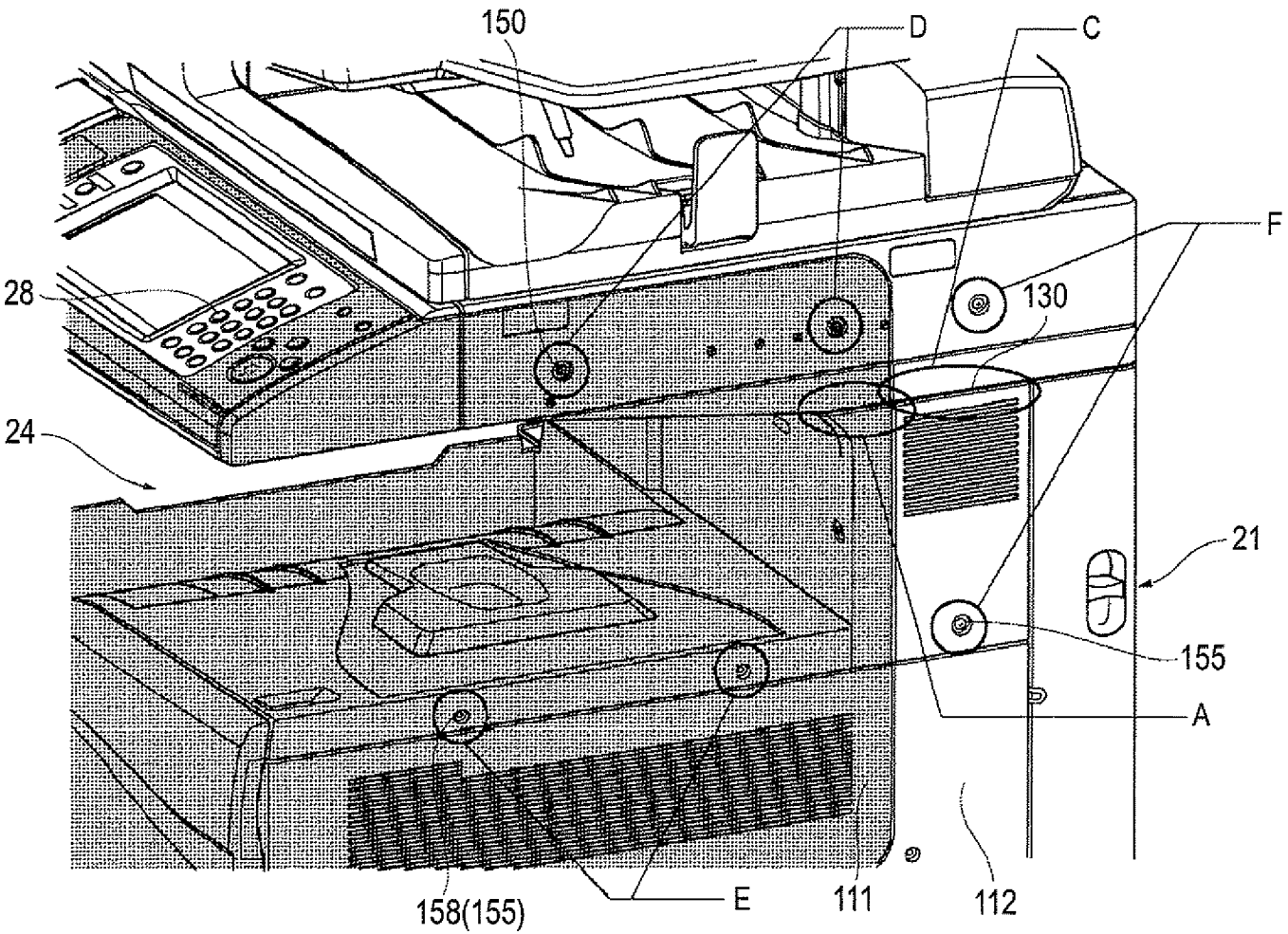
FIG. 6 is a diagram showing a fixing structure of an exterior cover used in the first exemplary embodiment.
Figure 7A:
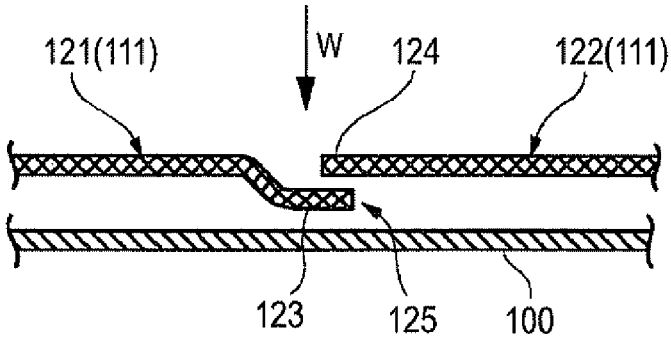
FIG. 7A is a cross-sectional view of an A portion in FIG. 6.

In some cases, plural cover members 121 and 122 are adjacently disposed as the specified-color exterior cover 111 on one certain surface of the apparatus housing 21 as indicated by A in FIGS. 5 and 6. At this time, in this exemplary embodiment, as shown in FIG. 7A, overhead flanges 123 and 124 are respectively provided to the cover members 121 and 122 of the specified-color exterior cover 111 so that one of the overhead flanges 123 and 124 extends over the end of the cover member 122 or 121 of the other overhead flange 124 or 123 at the adjacent sites of those cover members 121 and 122. In this exemplary embodiment, one overhead flange 123 extends while bent to the housing frame 100 side and the other overhead flange 124 extends just linearly so that both the overhead flanges 123 and 124 are overlapped with each other. Accordingly, the overhead flanges 123 and 124 act as a blind portion 125 for interrupting the visual line from the external as indicated by an arrow W.

As a result, even when the adjacent site between the cover members 121 and 122 of the specified-color exterior cover 111 is viewed from the external, the surface of the housing frame 100 is blinded by the blind portion 125 including the overhead flanges 123 and 124, so that the surface of the housing frame 100 is hardly exposed through the adjacent site between the cover members 121 and 122.

(2) Gap Treatment 2

Figure 7B:
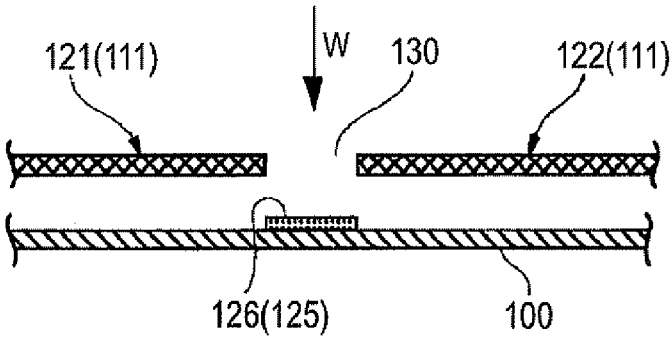
FIG. 7B is a diagram showing a modification of FIG. 7A.

Even when a gap 130 is formed at the adjacent site between the plural cover members 121 and 122 of the specified-color exterior cover 111, blind paint 126 is coated on the surface of the housing frame 100 at the position corresponding to the gap 130 between the cover members 121 and 122 as shown in FIG. 7B, for example, whereby the coating based on the blind paint 126 acts substantially as the blind portion 125.

Here, coating based on paint whose color is not different in hue from the specified-color exterior cover 111 (for example, blue paint or black paint) may be formed as the blind paint 126.

(3) Gap Treatment 3

Figure 7C:
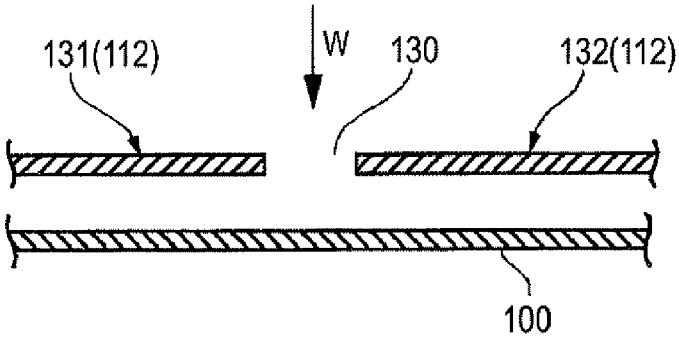
FIG. 7C is a cross-sectional view of a C portion in FIG. 6.

In some cases, plural cover members 131 and 132 are adjacently disposed as the unspecified-color exterior cover 112 on one certain surface of the apparatus housing 21 as indicated by C in FIGS. 5 and 6. At this time, even in a case where the gap 130 is formed between the plural cover members 131 and 132 as shown in FIG. 7C, if the surface of the housing 100 is exposed through the gap 130 between the cover members 131 and 132, there is no concern that the exposed portion causes conspicuous degradation in appearance quality because the color of the unspecified-color exterior cover 112 is not different in hue from the color of the housing frame 100.

Next, a fixing structure using a check for each of the specified-color exterior cover 111 and the unspecified-color exterior cover 112 will be described.

(1) Check Treatment 1

Figure 8A:
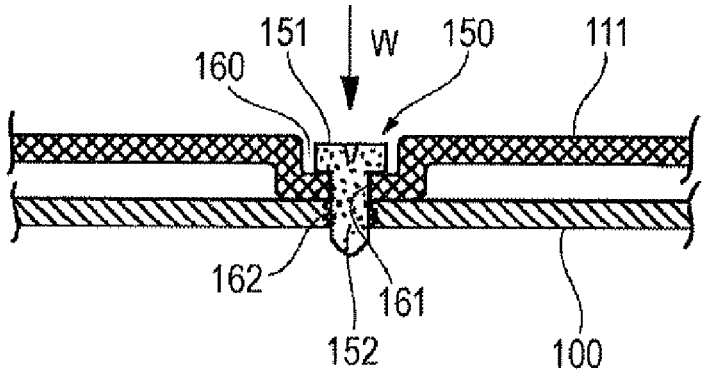
FIG. 8A is a cross-sectional view of a D portion in FIG. 6.

As indicated by D in FIGS. 5 and 6, the specified-color exterior cover 111 is fixed to the housing frame 100 by using checks 150. In this exemplary embodiment, as shown in FIG. 8A, the specified-color exterior cover 111 may have a fixing recess portion 160 formed therein. The fixing recess portion 160 mounts a head portion 151 of the check 150 thereon, and a screw portion 152 of the check 150 can be inserted into an insertion hole 161 formed in the bottom of the fixing recess portion 160. A color (blue, black) whose hue is not different from that of the specified-color exterior cover 111 may be selected as the color of the check 150. A female screw portion 162 in which the screw portion 152 of the check 150 is engagedly fitted is formed in the housing frame 100 as a fixing target in advance.

According to the fixing structure as described above, with respect to the check 150 of the specified-color exterior cover 111, the head portion 151 thereof is mounted in the fixing recess portion 160, and the screw portion 152 thereof is engagedly fitted in the female screw portion 162 of the housing frame 100 through the insertion hole 161 of the fixing recess portion 160. At this time, the head portion 151 of the check 150 is viewable from the external of the specified-color exterior cover 111. However, the check 150 is colored with a hue which is not different from that of the specified-color exterior cover 111, so that existence of the checks 150 in the area of the specified-color exterior cover 111 is not so conspicuous.

(2) Check Treatment 2

Figure 8B:
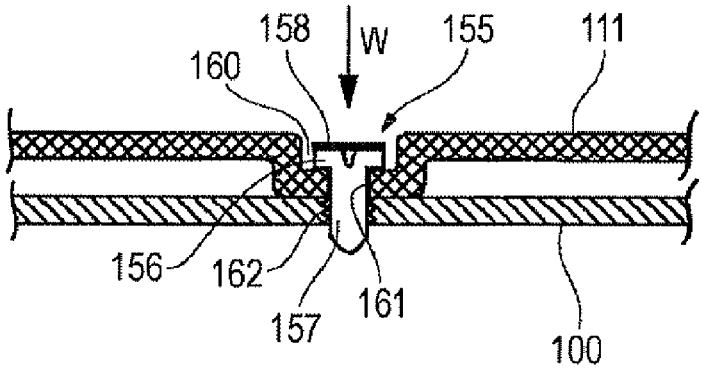
FIG. 8B is a cross-sectional view of an E portion in FIG. 6.
Figure 8C:
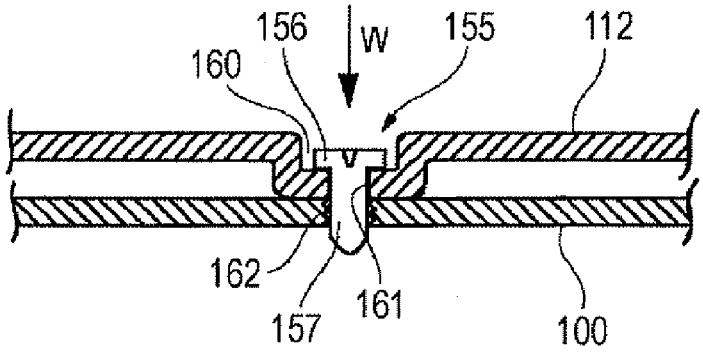
FIG. 8C is a cross-sectional view of an F portion in FIG. 6.

As indicated by E in FIGS. 5 and 6, the specified-color exterior cover 111 is fixed to the housing frame 100 through checks 155. In this exemplary embodiment, as shown in FIG. 8B, the specified-color exterior cover 111 has the fixing recess portion 160 formed therein, in which a head portion 156 of the check 155 is mounted. The insertion hole 161 into which a screw portion 157 of the check 155 can be inserted is formed in the bottom of the fixing recess portion 160, and the screw portion 157 is engagedly fitted in a female screw portion 162 of the housing frame 100. Unlike FIG. 8A, the check 155 itself is a silver screw, for example, and a blind paint 158 of color (for example, blue or black) which is not different in hue from the color of the specified-color exterior cover 111 is coated on the head portion 156 of the check 155.

According to this exemplary embodiment, even when the specified-color exterior cover 111 is fixed to the housing frame 100 through the check 155, the head portion 156 of the check 155 is blinded by the blind paint 158. Therefore, the head portion 156 of the check 155 is not directly exposed to the outside, and thus there hardly occurs such a situation that the check 155 is conspicuous in the area of the specified-color exterior cover 111.

(3) Check Treatment 3

As indicated by F in FIGS. 5 and 6, for example, the unspecified-color exterior cover 112 is fixed to the housing frame 100 through the checks 155.

At this time, the unspecified-color exterior cover 112 has the fixing recess portion 160 formed therein, in which the head portion 156 of the check 155 is mounted. The insertion hole 151 into which the screw portion 157 of the check 155 can be inserted is formed in the bottom of the fixing recess portion 160 and the screw portion 157 is engagedly fitted in the female screw portion 162 of the housing frame 100. For example, the head portion 156 of the check 155 such as a silver screw or the like is mounted in the fixing recess portion 160 in the area of the unspecified-color exterior cover 112, however, the head portion is exposed to the surface.

However, the check 155 is colored with a hue which is not different from that of the color of the unspecified-color exterior cover 112, and thus there is little concern that existence of the check 155 is conspicuous in color in the area of the unspecified-color exterior cover 112.

Comparison Example

Figure 9:
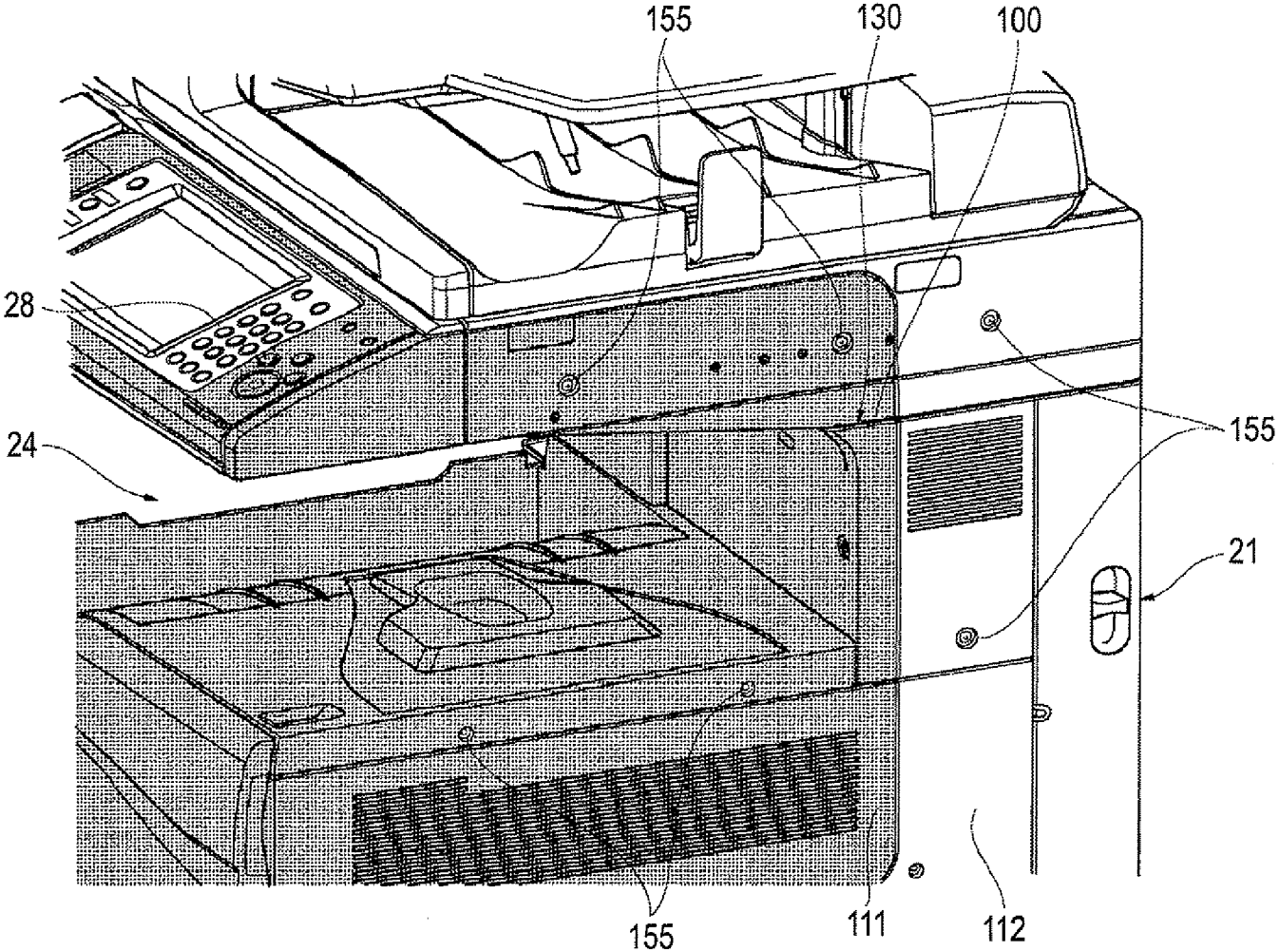
FIG. 9 is a diagram showing a fixing structure of an exterior cover used in a comparative example.

According to this exemplary embodiments, the gap treatment 1 or 2 and the check treatment 1 or 2 are executed in the area of the specified-color exterior color 111. However in a comparative example of FIG. 9, when the gap treatment 3 or the check treatment 3 is executed in the area of the specified-color exterior cover 111, the surface of the housing frame 100 is exposed through the gap 130 between the plural cover members 121 and 122 of the specified-color exterior cover 111, and the head portion 156 (for example, silver color) of the check 155 is exposed. Therefore, it is observed that the surface of the housing frame 100 or the check 155 is extremely conspicuous in the area of the specified-color exterior cover 111. As a result, it is understood that the gap treatment 1 or 2 and the check treatment 1 or 2 according to the exemplary embodiments are remarkably effective.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The exemplary embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An apparatus housing comprising:

a housing frame that contains an image forming element therein; and an exterior cover fixed to an exterior of the housing frame, wherein the exterior cover has a specified-color exterior cover different in lightness from the housing frame, the specified-color exterior cover has a plurality of cover members that are adjacent to each other and disposed on at least one surface of the housing frame, and a blind portion for blinding the surface of the housing frame with a color whose lightness is more similar to that of the specified-color exterior cover than the housing frame is provided at an adjacent area between the plurality of cover members so that the blind portion prevents the surface of the housing frame from being exposed through a gap between the plurality of cover members, and wherein the blind portion is provided to at least one of the plurality of cover members, and the blind portion extends to cover the entire adjacent area of the other cover members.

2. The apparatus housing according to claim 1, wherein the specified-color exterior cover has a lightness that is different by three or more in Munsell value from that of the housing frame.

3. The apparatus housing according to claim 1, wherein the exterior cover has an unspecified-color exterior cover that includes a plurality of cover members and is provided separately from the specified-color exterior cover, the unspecified-color exterior cover being not different in lightness from the housing frame and, wherein the plurality of adjacent cover members of the specified-color exterior cover have the adjacent area along an adjacent area between the plurality of cover members of the unspecified-color exterior cover.

4. The apparatus housing according to claim 1, wherein the specified-color exterior cover is attached to the housing frame with an attachment, and a head portion of the attachment is colored with a lightness that is not different from that of the specified-color exterior cover.

5. The apparatus housing according to claim 1, wherein the specified-color exterior cover has an attaching recess portion in which a head portion of the attachment is held so that the head portion is not exposed from the surface, and the specified-color exterior cover is attached to the housing frame with the attachment in the attaching recess portion.

6. An apparatus housing comprising:

a housing frame that contains an image forming element therein; and an exterior cover fixed to an exterior of the housing frame, wherein the exterior cover has a specified-color exterior cover different in lightness from the housing frame, the specified-color exterior cover has a plurality of cover members that are adjacent to each other and disposed on at least one surface of the housing frame, and a blind portion for blinding the surface of the housing frame with a color whose lightness is more similar to that of the specified-color exterior cover than the housing frame is provided at an adjacent area between the plurality of cover members so that the surface of the housing frame is not exposed through a gap between the plurality of cover members, and wherein the blind portion is formed by coloring the surface of the housing frame at the adjacent area between the plurality of cover members with a lightness that is not different from that of the specified-color cover member.

7. The apparatus housing according to claim 6, wherein the specified-color exterior cover has a lightness that is different by three or more in Munsell value from that of the housing frame.

8. The apparatus housing according to claim 6, wherein the exterior cover has an unspecified-color exterior cover that includes a plurality of cover members and is provided separately from the specified-color exterior cover, the unspecified-color exterior cover being not different in lightness from the housing frame and, wherein the plurality of adjacent cover members of the specified-color exterior cover have the adjacent area along an adjacent area between the plurality of cover members of the unspecified-color exterior cover.

9. The apparatus housing according to claim 6, wherein the specified-color exterior cover is attached to the housing frame with an attachment, and a head portion of the attachment is colored with a lightness that is not different from that of the specified-color exterior cover.

10. The apparatus housing according to claim 6, wherein the specified-color exterior cover has an attaching recess portion in which a head portion of the attachment is held so that the head portion is not exposed from the surface, and the specified-color exterior cover is attached to the housing frame with the attachment in the attaching recess portion.

11. An image forming apparatus comprising:

an apparatus housing including a housing frame that contains an image forming element therein and an exterior cover fixed to the exterior of the housing frame; and the image forming element contained in the apparatus housing, wherein the exterior cover has a specified-color exterior cover different in lightness from the housing frame, the specified-color exterior cover has a plurality of cover members that are adjacent to each other and disposed on at least one surface of the housing frame, and a blind portion for blinding the surface of the housing frame with a color whose lightness is more similar to that of the specified-color exterior cover than the housing frame is provided at an adjacent area between the plurality of cover members so that the blind portion prevents the surface of the housing frame from being exposed through a gap between the plurality of cover members, and wherein the blind portion is provided to at least one of the plurality of cover members, and the blind portion extends to cover the entire adjacent area of the other cover members.

12. The image forming apparatus according to claim 11, wherein the apparatus housing comprises: a lower apparatus housing containing an imaging element that forms an image on a recording medium; an upper apparatus housing containing an image reading element that reads a document image to be formed on the recording medium; and a recording medium stacking unit that is disposed between the lower apparatus housing and the upper apparatus housing and stacks the recording medium on which the image is formed by the imaging element in the lower apparatus housing, wherein the specified-color exterior cover is provided to at least a part of the recording medium stacking unit and an area adjacent to the recording medium stacking unit in the apparatus housing, and an unspecified-color exterior cover is provided at the outside of the specified-color exterior cover.

13. The image forming apparatus according to claim 11, wherein the specified-color exterior cover has a lightness that is different by three or more in Munsell value from that of the housing frame.

14. The image forming apparatus according to claim 11, wherein the exterior cover has an unspecified-color exterior cover that includes a plurality of cover members and is provided separately from the specified-color exterior cover, the unspecified-color exterior cover being not different in lightness from the housing frame and, wherein the plurality of adjacent cover members of the specified-color exterior cover have the adjacent area along an adjacent area between the plurality of cover members of the unspecified-color exterior cover.

15. The image forming apparatus according to claim 11, wherein the specified-color exterior cover is attached to the housing frame with an attachment, and a head portion of the attachment is colored with a lightness that is not different from that of the specified-color exterior cover.

16. The image forming apparatus according to claim 11, wherein the specified-color exterior cover has an attaching recess portion in which a head portion of the attachment is held so that the head portion is not exposed from the surface, and the specified-color exterior cover is attached to the housing frame with the attachment in the attaching recess portion.

17. An image forming apparatus comprising:

an apparatus housing including a housing frame that contains an image forming element therein and an exterior cover fixed to the exterior of the housing frame; and the image forming element contained in the apparatus housing, wherein the exterior cover has a specified-color exterior cover different in lightness from the housing frame, the specified-color exterior cover has a plurality of cover members that are adjacent to each other and disposed on at least one surface of the housing frame, and a blind portion for blinding the surface of the housing frame with a color whose lightness is more similar to that of the specified-color exterior cover than the housing frame is provided at an adjacent area between the plurality of cover members so that the surface of the housing frame is not exposed through a gap between the plurality of cover members, and wherein the blind portion is formed by coloring the surface of the housing frame at the adjacent area between the plurality of cover members with a lightness that is not different from that of the specified-color cover member.

18. The image forming apparatus according to claim 17, wherein the apparatus housing comprises: a lower apparatus housing containing an imaging element that forms an image on a recording medium; an upper apparatus housing containing an image reading element that reads a document image to be formed on the recording medium; and a recording medium stacking unit that is disposed between the lower apparatus housing and the upper apparatus housing and stacks the recording medium on which the image is formed by the imaging element in the lower apparatus housing, wherein the specified-color exterior cover is provided to at least a part of the recording medium stacking unit and an area adjacent to the recording medium stacking unit in the apparatus housing, and an unspecified-color exterior cover is provided at the outside of the specified-color exterior cover.

19. The image forming apparatus according to claim 17, wherein the specified-color exterior cover has a lightness that is different by three or more in Munsell value from that of the housing frame.

20. The image forming apparatus according to claim 17, wherein the exterior cover has an unspecified-color exterior cover that includes a plurality of cover members and is provided separately from the specified-color exterior cover, the unspecified-color exterior cover being not different in lightness from the housing frame and, wherein the plurality of adjacent cover members of the specified-color exterior cover have the adjacent area along an adjacent area between the plurality of cover members of the unspecified-color exterior cover.

* * * * *